US006148707A

United States Patent [19]

Kouno

[11] Patent Number: 6,148,707

[45] Date of Patent: Nov. 21, 2000

[54] PUNCH PRESS AND METHOD OF PUNCHING PLATE-TYPE WORKPIECE BY THE PRESS

[75] Inventor: Shigeyoshi Kouno, Kanagawa, Japan

[73] Assignee: Amada Company, Limited, Kanagawa, Japan

[21] Appl. No.: 08/974,880

[22] Filed: Nov. 20, 1997

Related U.S. Application Data

[63] Continuation of application No. 08/475,986, Jun. 7, 1995, abandoned, which is a continuation of application No. 08/207,112, Mar. 8, 1994, abandoned, which is a continuation-in-part of application No. 07/933,113, Aug. 21, 1992, abandoned.

[30] Foreign Application Priority Data

Sep. 3, 1991 [JP] Japan ..... 3-222836
Aug. 18, 1992 [JP] Japan ..... 4-219164

[51] Int. Cl.[7] ..... B26F 1/08

[52] U.S. Cl. ..... 83/552; 83/549

[58] Field of Search ..... 83/552, 571, 698.91, 83/549

[56] References Cited

U.S. PATENT DOCUMENTS

| | | | |
|---|---|---|---|
| 3,449,991 | 6/1969 | Daniels . | |
| 3,685,380 | 8/1972 | Daniels . | |
| 4,007,653 | 2/1977 | Cady | 83/698.91 |
| 4,250,785 | 2/1981 | Morishita et al. | 83/552 |
| 4,343,210 | 8/1982 | Kuroyone . | |
| 4,412,469 | 11/1983 | Hirata et al. . | |
| 4,532,845 | 8/1985 | Jinnouchi . | |
| 4,658,688 | 4/1987 | Shah et al. | 83/552 |
| 4,929,276 | 5/1990 | Chun et al. | 83/552 |
| 4,976,180 | 12/1990 | Otto . | |
| 4,998,958 | 3/1991 | Chun et al. | 83/133 |
| 5,048,385 | 9/1991 | Eckert et al. . | |
| 5,119,666 | 6/1992 | Fujiwara | 83/552 |
| 5,211,095 | 5/1993 | Chun et al. | 83/552 |

FOREIGN PATENT DOCUMENTS

| | | |
|---|---|---|
| 0310908 | 4/1989 | European Pat. Off. . |
| 027393 | 7/1977 | Japan . |
| 9005601 | 5/1990 | WIPO . |

*Primary Examiner*—Kenneth E. Peterson
*Attorney, Agent, or Firm*—Blank Rome Comisky & McCauley, LLP

[57] ABSTRACT

A punch press includes a pair of disc-shaped tool holders rotatably mounted on supporting portions, one of the holders carrying a plurality of punch tools, and the other holder carrying a plurality of die tools which cooperate with the punch tools in order to punch a workpiece. A striker is attached to a vertically movable ram, wherein the striker is movable to a position into which desired punch and die tools attached to the pair of tool holders are indexed in order to change direction of the tools by rotating the pair of tool holders.

11 Claims, 7 Drawing Sheets

PUNCH PRESS AND METHOD OF PUNCHING PLATE-TYPE WORKPIECE BY THE PRESS

This is a continuation of application Ser. No. 08/475,986, filed on Jun. 7, 1995, now abandoned which is a continuation of application Ser. No. 08/207,112, filed Mar. 8, 1994, now abandoned, which is a continuation-in-part of application Ser. No. 07/933,113, filed Aug. 21, 1992, now abandoned.

BACKGROUND OF THE INVENTION

1. Field of the Invention

This invention relates to a punch press and a method of punching plate-type workpieces, and in particular to a punch press provided with one or more than two pairs of disc-shaped rotatable tool holders each of which supports a plurality of punches or dies, and a method of processing plate-type workpieces by the punch press.

2. Description of the Prior Art

As a conventional punch press is known a turret punch press comprised of a frame, an upper and a lower turrets rotatably mounted on the frame, for carrying a number of punch and die tools at the outer peripheries of the turrets, and a striker attached to the frame, for striking one of the punches. The punch to be struck is positioned or indexed under the striker when the workpiece is punched.

Japanese Patent Publication No. 52-27393 discloses a turret punch press comprised of an upper and lower turrets on which a number of punches and dies are arranged in several concentric circles so that some punches and dies respectively align in the radial directions of the upper and lower turrets. The punch press has a striker movable in a radial direction of the turrets.

U.S. Pat. No. 4,412,469 discloses a turret punch press of which upper and lower turrets carry rotatable punch and die tools. The punch and die tools can be rotated and positioned or indexed as desired.

Another U.S. Pat. No. 4,976,180 discloses a turret punch press provided with upper and lower turrets to which a pair of rotatable disc-shaped tool holders for carrying a plurality of punch and die tools are attached. The position or direction of the tool is changed by the rotation of the tool holder.

In the above-mentioned turret punch press including the upper and lower turrets carrying a number of punch and die tools, the turrets are turned or indexed in order to position the tools with respect to the striker. After the turrets are Indexed as mentioned above, then the tool holder rotates to index the predetermined tools under the striker. The punch and die tools are immovably attached to the holders and are therefore not rotated automatically with respect to the holders. The tools may be rotatably attached to the holders. Making such a complicated configuration, however, in which the tools rotatably mounted on the rotatable holders attached to the rotatable turrets will make the tool portion and the holder portion larger and require larger spaces.

SUMMARY OF THE INVENTION

The primary object of the present invention is to provide an improved punch press, wherein a striker of the press can move to a given position into which punch and die tools of the press are indexed by rotation of tool holders rotatably mounted on the press.

A punch press of the present invention is comprised of tool holder portions supporting a pair of disc-shaped tool holders, one of the holders carrying a plurality of punch tools and the other holder carrying a plurality of die tools which cooperate with the punch tools in order to punch a plate-type workpiece; a reciprocatingly movable ram; and a striker mounted on the ram, wherein the striker is movable onto the punch and die tools which are positioned by rotation of the tool holders.

In the above configuration, when the pair of die holders rotate the directions of punch and die tools attached to the holders change. For example, when the punch and die tools face in the X direction and rotate 90 degrees, the tools turn in the Y direction perpendicular to the X direction. In other words, the tools move to a position of which phase shifts 90 degrees from the original position with respect to the radius of rotation of the tool.

The striker for hitting the punch tool attached to the punch holder can move to a position into which the tools are indexed by changing their direction and position, and therefore can punch the workpiece even if the direction and position of the punch and die tools are changed.

DESCRIPTION OF THE PREFERRED EMBODIMENTS

Figure 1:
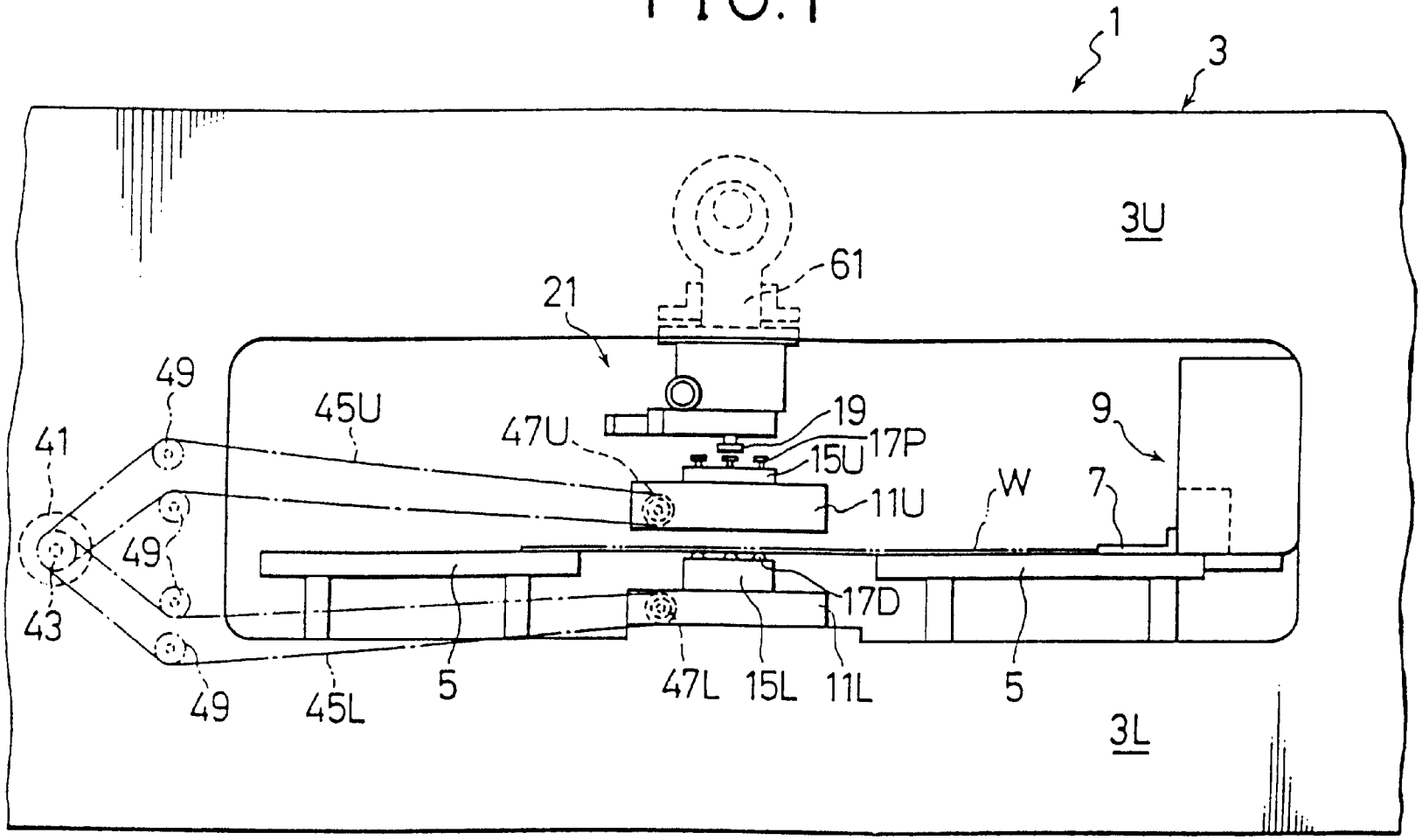
FIG. 1 is a front view of a punch press of the present invention.
Figure 2:
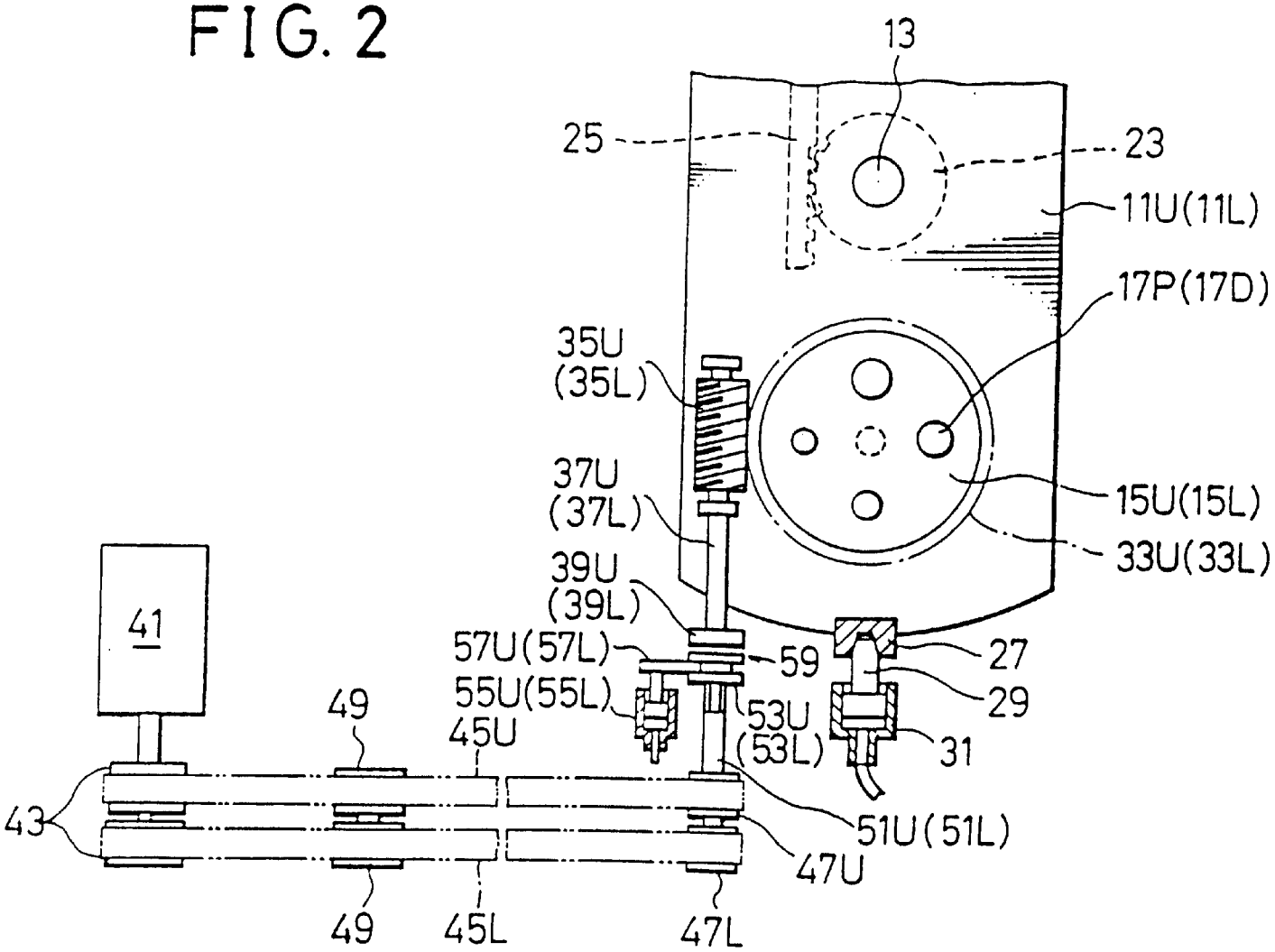
FIG. 2 is a plan view showing the primary portion of the punch press of the FIG. 1.

FIGS. 1 and 2 are front view of a punch press 1 of the invention and plan view of the primary portion of the punch press.

The punch press 1 has a portal frame 3 comprised of upper frame 3U and lower frame 3L. The lower frame 3L is provided with a worktable 5 a for supporting a plate-type workpiece W. The frame 3 is also provided with workclamps 7 for clamping the workpiece W and a work positioner 9 for moving the workpiece W in the X and Y directions to position it. The work positioner 9 is known and used for a conventional turret punch press, and therefore a further description will be omitted.

The upper and lower frames 3U and 3L of the frame 3 respectively support upper and lower turrets 11U and 11L which rotate about axes 13 (see FIG. 2). The design for attaching the upper and lower turrets 11U and 11L to the frame 3 may be similar to that of a conventional turret punch press, and therefore a further description of the design will be omitted.

The upper and lower turrets 11U and 11L act as tool holder supporting portions for supporting punch and die holders 15U and 15L and are, in this embodiment, in the shape of beam or bar. The punch and die holders 15U and 15L are rotatably mounted on longitudinal ends of the upper and lower turrets 11U and 11L. A plurality of punch and die tools 17P and 17D are concentricly attached to the punch holder 15U and the die holder 15L.

In order to punch the workpiece W by striking the punch tool 17P, the upper frame 3U of the frame 3 has a vertically movable striker device 21 provided with a striker 19.

The design for rotating the turrets 11U and 11L may be the same as that of a conventional turret punch press. In this embodiment, however, the turrets or beams may rotate by 180 degrees. Hence, each turret is turned by pinion 23 and rack 25 as shown in FIG. 2. The pinion 23 is attached to the axis 13 of the turret and engaged with the rack 25 which is reciprocatingly moved by a known actuator such as a pneumatic or hydraulic cylinder (not shown).

In order to lock the turned and positioned upper and lower turrets 11U and 11L, both ends of the turrets are provided with catch blocks 27, while the frame 3 is provided with lock pins 29 and hydraulic cylinders 31. The hydraulic cylinders 31 activate the lock pins 29 to engage the catch blocks 27 to lock the turrets.

The circumferential surfaces of the disc-shaped tool holders 15U and 15L are formed with worm gears 33U and 33L which engage with rotatable worm gears 35U and 35L mounted on the turrets 11U and 11L. Axes 37U and 37L of the worm gears 35U and 35L extend outward from the turrets. A clutch nail 39U or 39L is attached to an end of each axis 37U or 37L.

The frame 3 supports a servo motor 41 with a pair of pulleys 43, 43 and another pair of, or upper and lower pulleys 47U and 47L for turning the tool holders 15U and 15L through the worms 35U and 35L (the supporting configuration is omitted In the drawing). The upper and lower pulleys 47U and 47L are so disposed as to face the worm gears 35U and 35L. As shown in FIGS. 1 and 2, an upper drive belt 45U is expanded around the one pulley 43 of the motor 41 and the upper pulley 47U, while a lower drive belt 45L is expanded around the other pulley 43 and the lower pulley 47L. The upper and lower belts 45U and 45L are tensioned by a plurality of tension pulleys 49. Axes 51U and 51L of the upper and lower follower pulleys 47U and 47L respectively engage upper and lower spline shafts 51U and 51L each of which is provided at its one end with a clutch nail 53U or 53L for engaging the clutch nail 39U or 39L of the worm gears 35U or 35L. For engaging and disengaging the clutch nails 53U and 53L from the clutch nails 39U and 39L of the worm gears 35U and 35L, clutch cylinder 55U and 55L are mounted on the frame 3. A shifter arm 57U or 57L is attached to an end of a piston rod of the clutch cylinder 55U or 55L. The shifter arms 57U and 57L fit into circumferential grooves of the clutch nails 53U and 53L so as to cause the clutch nails 53U and 53L to move reciprocatingly toward and away from the opposite clutch nails 39U and 39L.

The clutch nails 53U and 39U, or 53L and 39L engage or disengage each other when a clutch mechanism 59 comprised of the clutch nails 39U and 53U and the clutch cylinder 55U, or of the clutch nails 39L and 53L and the clutch cylinder 55L operates. By driving the servo motor 41 when the worm gears 35U and 35L are connected to the opposite clutch nails 39U and 39L, the punch and die tool holders rotate simultaneously in the same direction, and therefore desired punch and die tools In the tool holders are indexed or positioned with respect to the striker 19 of the striker device 21.

The turrets 11U and 11L rotate to index desired tool holders 15U (15L) under striker 19 when the lock of the turrets by lock pins 29 is released and the clutch nails 39U and 53U, and 39L and 53L are disconnected.

Figure 9:
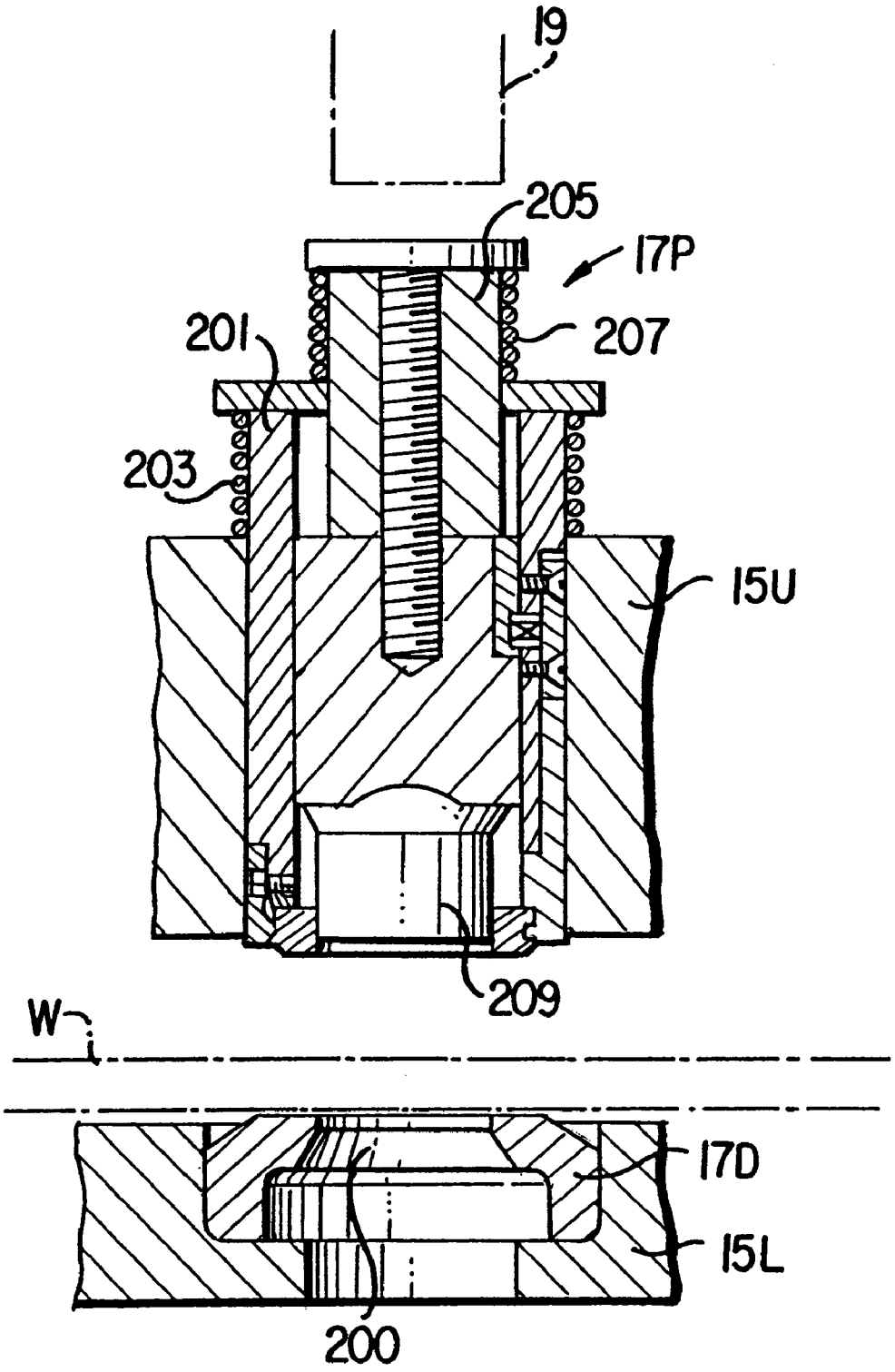
FIG. 9 is a sectional view of punch and die tools.

FIG. 9 shows the punch and die tools 17P, 17D supported on the tool holders 15U, 15L. Specifically, the die tool 17D supported on the tool holder 15L is formed with the die hole 200. The punch tool 17P supported on the tool holder 15U includes a punch guide 201 supported on the tool holder 15U so as to be movable in the vertical direction. A first spring 203 is provided between the tool holder 15U and the punch guide 201 for urging the punch guide 201 upward. A punch body 205 is provided in the punch guide 201 so as to be movable in the vertical direction. A second spring 207 is provided between the punch guide 201 and the punch body 205 for urging the punch body 205 upward relative to the punch guide 201. The punch body 205 is formed with a punch tip 209 for cooperating with a die hole 200 to process a workpiece W.

The horizontal cross-section of the punch tip 209 may be a round shape, a square shape, a rectangular shape (see FIG. 3), a triangular shape, or the like. It should be noted that when the horizontal cross-section is a square shape, a rectangular shape, a triangular shape, or the like, the shape of the horizontal cross-section has a specific direction or axis. For example, the horizontal cross-section P having a rectangular shape as shown in FIG. 3 has a longitudinal direction or longitudinal axis A, which is in the X-axis direction in FIG. 3.

Figure 3:
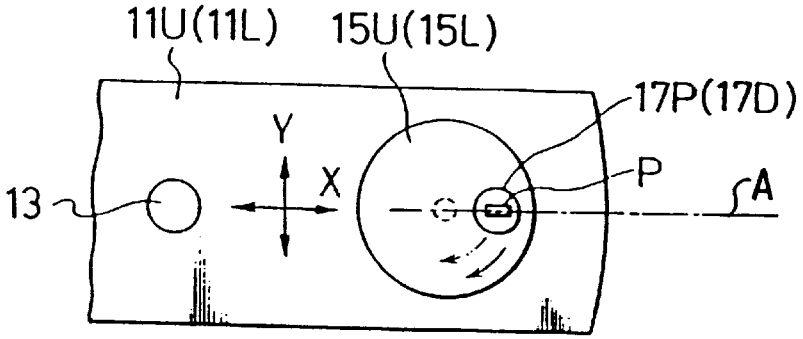
FIG. 3 is a plan view of the primary portion showing change in the direction of punch and die tools.
Figure 4:
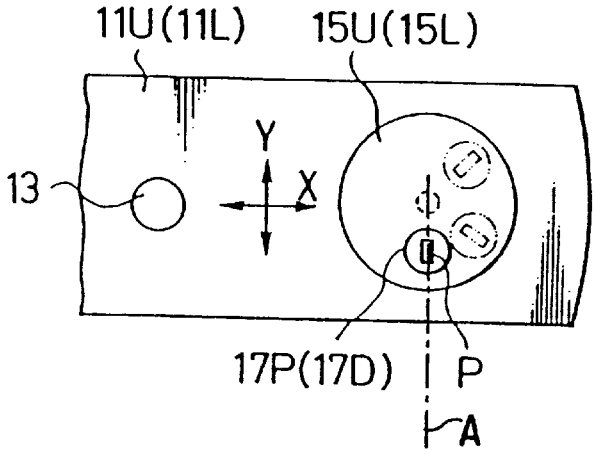
FIG. 4 is another plan view of the primary portion showing the change of directions of the punch and the dies.

In FIG. 3, one of the punch tools 17P supported on the tool holder (15U) is explicitly illustrated, and the other shapes of the punch tools 17P are omitted in FIG. 3 for the sake of simplicity. The punch tool 17P explicitly illustrated in FIG. 3 has the punch top 209 with the rectangular horizontal cross-section P. In particular, in the position of tool holder (15U) as illustrated in FIG. 3, the longitudinal direction A of the rectangular horizontal cross-section P is in the X-axis direction, as mentioned above. As shown in FIG. 4, when the tool holder 15U is rotated, the longitudinal direction A of the rectangular horizontal cross-section P is changed from the X-axis direction to the Y-axis direction.

As understood from the above description, the tool holders 15U, 15L rotate with respect to the upper and lower turrets 11U, 11L. When the tool holders rotate 90 degrees with respect to the turrets, the direction (longitudinal direction) A of punching area (horizontal cross-section) P of the tools 17P, 17D change from the X direction shown in FIG. 3 into the direction Y shown in FIG. 4 and the positions or phases of the punch and die tools 17P, 17D shift 90 degrees. The directions of the punching areas P or the tools 17P, 17D and positions of the tools change as desired by controlling the rotation of the holders.

It becomes necessary to move the striker 19 of the striker device 21 with respect to the change In the position of the punch and die tools 17P, 17D. In this embodiment, the striker 19 is so designed as to move to the changed position of the tools.

With this arrangement, when the punch tip 209 (the die hold 200) of a punch tool 17P (die tool 17D) supported on the tool holder 15U (15L) has a horizontal cross-section with a shape having a separate direction or axis, the specific direction or axis can be changed into any desired horizontal direction.

A vertically movable ram 61 (FIG. 1) activated by means of a conventional hydraulic cylinder mechanism or the like (not shown) is mounted on the frame 3. The striker device 21 is disposed under the ram 61 and provided with the striker 19 which is movable to change its position.

Figure 5:
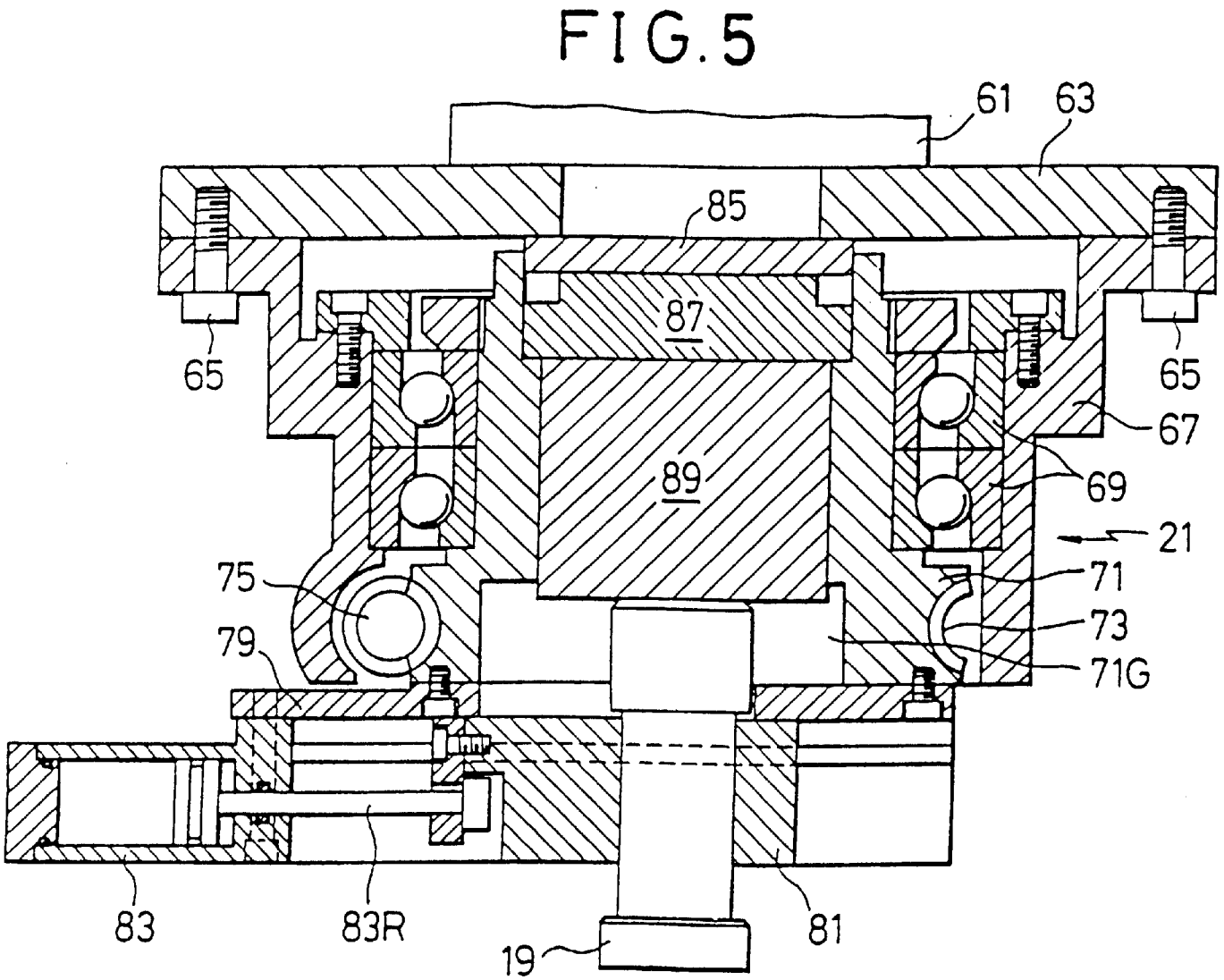
FIG. 5 is a sectional view, in a large scale, of a striker device of the punch press of FIG. 1.
Figure 6:
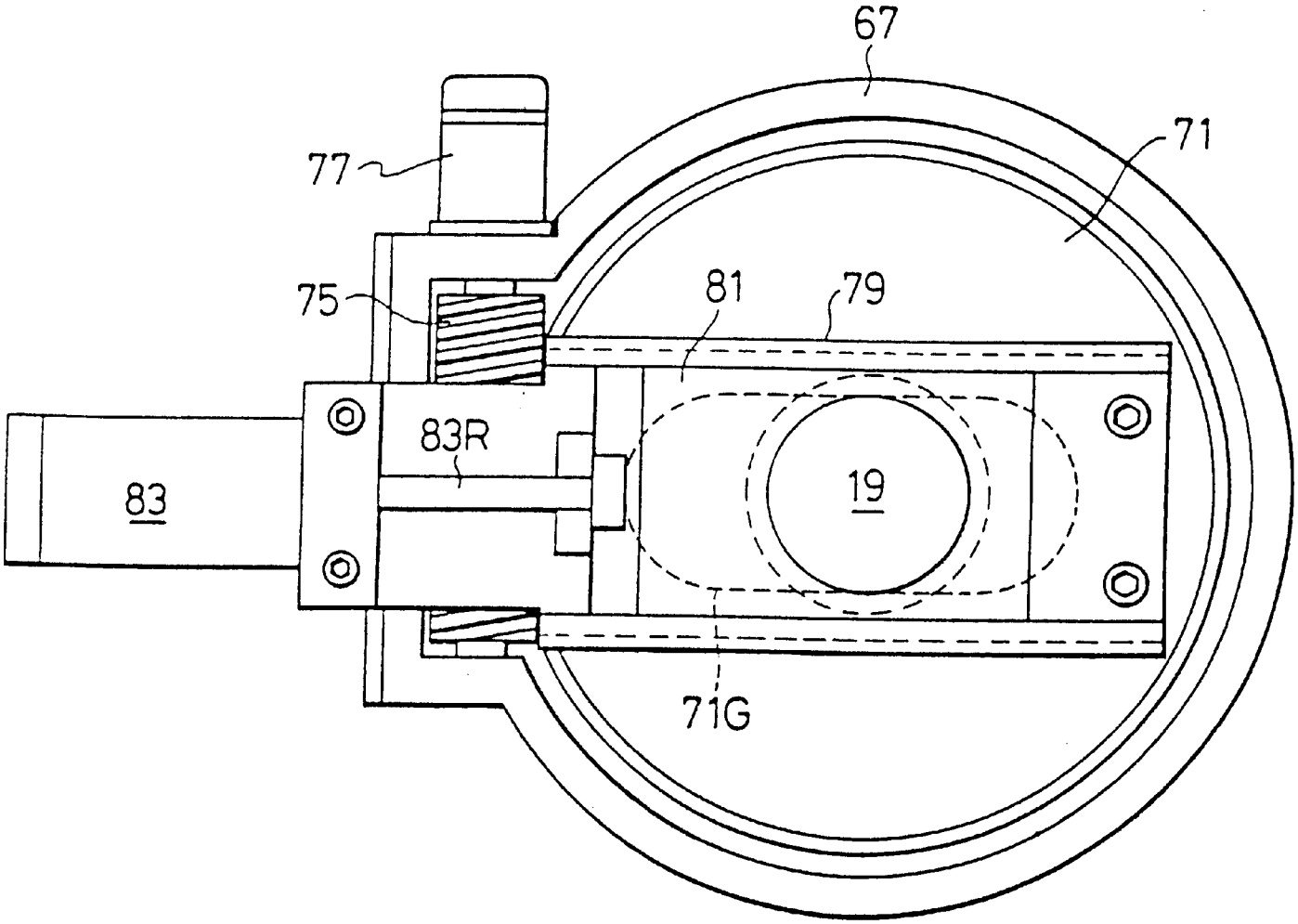
FIG. 6 is a bottom view of the striker of FIG. 5.

FIGS. 5 and 6 show the details of the striker device 21. A supporting plate 63 is secured to a bottom portion of the ram 61 by bolts or the like (not shown). A casing 67 is integrally attached to the supporting plate 63 by a plurality of bolts 65. The casing 67 supports inside a cylinder-shaped revolving body 71 through a plurality of bearings 69.

An outer annular surface of a lower portion of the revolving body 71 is formed with a worm gear 73 which engages a rotatable worm 75 mounted on the casing 67. The worm gear 75 is rotated by a servo motor 77 (FIG. 6) mounted on the casing 67. A guide member 79 extending in a radial direction of the revolving body 71 is attached to the bottom surface of the revolving body 71 by means of bolts. The guide member 79 supports a block 81 which moves along the guide member 79 while carrying the striker 19. In order to move the block 81 along the guide member 79, a transfer cylinder 83 is attached to one end of the guide member 79. A free end of a piston rod 83R is connected to the transfer cylinder 83 for reciprocatingly moving the block 81 carrying the striker 19.

It should be noted that the striker device 21 is arranged such that when the tool holder 15U, 15L is located under the striker device 21, the center of the tool holders 15U, 15L is just under the center of the revolving body 71. When punching is performed, the striker 19 is located just above a specific punch tool 17P supported on the tool holder 17P. In view of the foregoing arrangement, after punching, when the tool holder 15U is rotated through a predetermined angle, the striker 19 can be brought to a position again just above the specific punch tool 17P by the rotation of the revolving body 71 through the same angle as the tool holder 15U.

When the transfer cylinder operates, the block 81 carrying the striker 19 moves in the radial direction of the revolving body 71. Hence, the striker 19 moves to the center or in the radial direction of the tool holders 15U, 15L. As the revolving body 71 can be rotated while the striker 19 is positioned off the center of the revolving body 71, the striker 19 can move as desired with respect to the change in the position of the punch and die tools 17P, 17D. The radius of rotation of the striker 19 is preferably equal to that of the punch and die tools 17P, 17D.

A top portion of the striker 19 extrudes upward from the block 81 into a groove 71G defined by the lower portion of the revolving body 71. A shear plate 85, anvil block 87 and power transmission block 89 are provided between the supporting plate 63 and the top portion of the striker 19. The ram 61 transmits its pressing force to the striker 19 through the shear plate 85 and the blocks 87 and 89. In view of this arrangement, when the ram 61 is under an overload, the upper section of the anvil block 87 moves upward to break the shear plate 85, so that the other members of the press are prevented from being damaged.

When punching of the workpiece W is carried out by a selected pair of punch and die tools 17P, 17D attached to the tool holders 15U, 15L and the position and direction of the tools are changed by the rotation of the tool holders, the servo motor 77 operates to rotate the revolving body 71 and move the striker 19 to the position into which the tools 17P, 17D has transferred.

Figure 7:
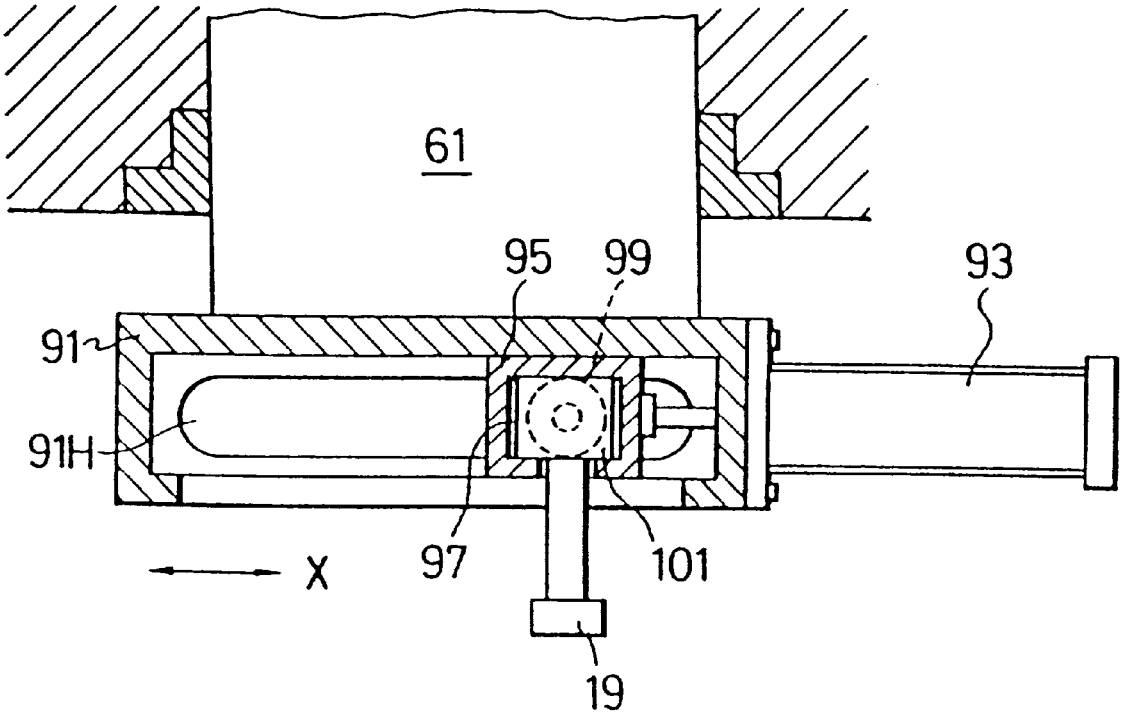
FIG. 7 is a sectional view of a second embodiment of the primary portion.

FIG. 7 shows a second embodiment of the mechanism for moving a striker 19 to a desired position. In this embodiment, an X-axis guide member 91 extending in the X direction is secured to a lower portion of the ram 61, and an X-axis slider 95 is mounted on the X-axis guide member 91. The X-axis slider 95 is moved by an X-axis cylinder 93 along the X-axis guide member 91. The X-axis slider is formed with Y-axis grooves 97 extending in the direction Y substantially perpendicular to the X direction. A Y-axis slider 101 which is moved by a Y-axis cylinder 99 engages the Y-axis grooves 97 of the X-axis slider 95 so as to slide in the Y direction. A striker 19 is secured to the Y-axis slider. The Y-axis cylinder 99 is provided so that it penetrates an elongate hole 91H formed in the X-axis guide member 91 and extending in the X direction.

In the above configuration, the striker can move in the X and Y directions with respect to the change in position of the tools.

Figure 8:
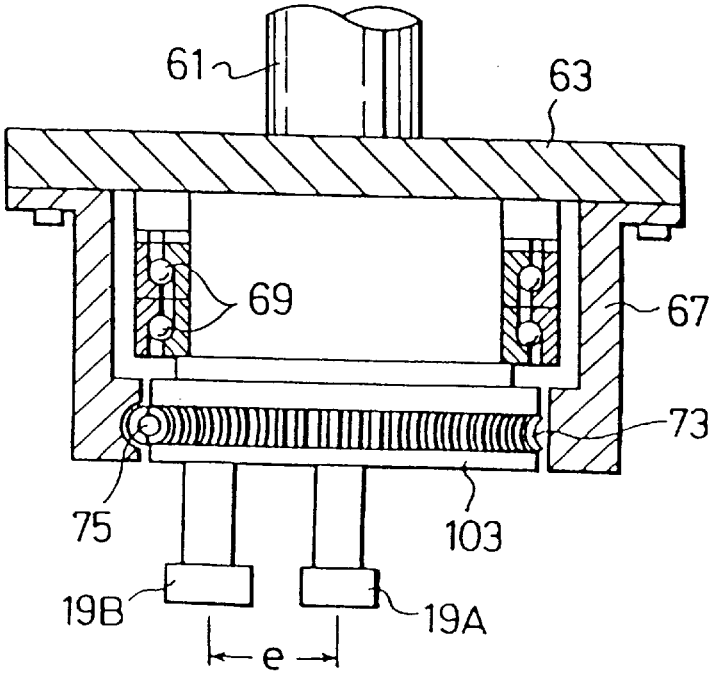
FIG. 8 is a sectional view of a third embodiment of the primary portion.

FIG. 8 shows a third embodiment of the mechanism for moving the striker 19 to a desired position. In this embodiment, a first striker 19A is provided at the center of a revolving body 103 which is mounted on the ram 61 in a way similar to that of the first invention. The same numeral references are assigned to the members which function the same as those of the first embodiment. A second striker 19B is provided apart from the first striker 19A by a distance e.

In this configuration, the first striker 19a hits a punch tool attached to the center of the punch holder, while the second striker 19B hits a plurality of punch tools attached to the punch holder apart from the center of the holder by the distance e.

What is claimed is:

1. A punch press comprising:

tool holder supporting portions;

a punch holder and a die holder each rotatably mounted on the supporting portions, said punch holder carrying a plurality of punch tools, said die holder carrying a plurality of die tools, and each of the die tools cooperating with one of the punch tools in order to punch a workpiece;

a vertically movable ram mounted on a punch press frame; and a striker mounted on the ram so as to be horizontally movable in a two-dimensional area relative to the ram and rotatably movable about an axis parallel to the ram;

wherein the punch holder and die holder are rotatable at least 90 degrees relative to the tool holder supporting portions, and the two-dimensional area in which the striker is movable covers every position to which at least one of the punch tools mounted on the punch holder is movable and to which a die corresponding to the at least one punch is movable when the punch and die holders are rotated 90 degrees.

2. The punch press of claim 1, wherein the ram is provided with a revolving body rotatable about the ram, and the striker is attached to the revolving body so as to move in a radial direction of the revolving body.

3. The punch press of claim 1, wherein the ram is provided with a slider movable in a direction, and the striker is mounted on the slider movably in a direction substantially perpendicular to the direction in which the slider is movable.

4. The punch press of claim 1, wherein the ram is provided with a revolving body rotatable about the ram, and the striker is attached to the revolving body apart from a center of a lower portion of the revolving body.

5. The punch press of claim 1, further comprising:

a revolving body mounted on a lower end of the ram so as be rotatable about a vertical axis of the ram; and a movable block mounted on a lower end of the revolving body so as to be movable in a radial direction of the revolving body;

the striker being fixed to the movable block.

6. The punch press of claim 5, wherein a center of the punch and die holders is just under a center of the revolving body when the punch and die holders are suitably located under the ram by rotation.

7. The punch press of claim 1, wherein the punch holder and die holder are rotatable 360 degrees relative to the tool holder supporting portions, and the two dimensional area in which the first striker is movable covers every position to which at least one of the punches mounted on the punch holder is movable and to which a die corresponding to the at least one punch is movable when the punch and die holders rotate 360 degrees.

8. The punch press of claim 1, further comprising a frame, wherein the tool holder supporting portions include first and second turrets, each rotatably supported by the frame, the first turret supporting the punch holder and the second turret supporting the die holder.

9. The punch press of claim 1, wherein each punch tool includes a punch guide supported on the punch holder so as to be movable in the vertical direction, a first spring being provided between the tool holder and the punch guide for urging the punch guide upward, a punch body being provided in the punch guide so as to be movable in the vertical direction, and a second spring being provided between the punch guide and the punch body for urging the punch body upward relative to the punch guide.

10. A punch press comprising:

a frame;

upper and lower turrets rotatably supported on the frame;

a punch holder rotatably supported on the upper turret, for supporting a plurality of punch tools;

a die holder rotatably supported on the lower turret, for supporting a plurality of die tools;

each of the punch tools cooperating with one of the die tools in order to process a workpiece;

a vertically movable ram mounted on the frame; and a striker mounted on the ram so as to be horizontally movable relative to the ram, wherein the striker is adapted to be movable to any position above the punch and die tools mounted on the punch and die holders when the punch and die holders are located substantially beneath the ram by rotation of the turrets;

wherein the punch holder and die holder are rotatable at least 90 degrees relative to the upper and lower turrets, and a two-dimensional area in which the striker is movable covers every position to which at least one of the punch tools mounted on the punch holder is movable and to which a die corresponding to the at least one punch is movable when the punch and die holders are rotated 90 degrees.

11. A punch press comprising:

tool holder supporting portions;

a punch holder and a die holder each rotatably mounted on the supporting portions, said punch holder carrying a plurality of punch tools, said die holder carrying a plurality of die tools, and each of the die tools cooperating with one of the punch tools in order to punch a workpiece;

a vertically movable ram mounted on a punch press frame;

a revolving body mounted on a lower end of the ram so as to be rotatable about a vertical axis of the ram;

a first striker mounted on the lower end of the revolving body, the first striker being located at a position in a peripheral region of the revolving body;

wherein the striker located at a position in a peripheral region is a first striker and the punch press further comprises a second striker mounted on the lower end of the revolving body, the second striker located at the center of the revolving body; and wherein the punch holder and die holder are rotatable at least 90 degrees relative to the tool holder supporting portions, and an area in which the striker is movable covers every position to which at least one of the punch tools mounted on the punch holder is movable and to which a die corresponding to at least one punch is movable when the punch and die holders rotate 90 degrees.

* * * * *